US005079474A

United States Patent [19]

Holten

[11] Patent Number: 5,079,474

[45] Date of Patent: Jan. 7, 1992

[54] ELECTRIC INCANDESCENT LAMP

[75] Inventor: Petrus A. J. Holten, Weert, Netherlands

[73] Assignee: U.S. Philips Corporation, New York, N.Y.

[21] Appl. No.: 573,929

[22] Filed: Aug. 23, 1990

[30] Foreign Application Priority Data

Sep. 11, 1989 [NL] Netherlands ..... 8902258

[51] Int. Cl.[5] ..... H01K 1/14; H01K 1/16; H01K 1/18

[52] U.S. Cl. ..... 313/113; 313/273; 313/277; 313/316

[58] Field of Search ..... 313/272, 273, 113, 316, 313/277

[56] References Cited

U.S. PATENT DOCUMENTS 1,168,077 1/1916 Jaeger ..... 313/277 X
1,601,470 9/1926 Collins ..... 313/277 X
2,573,775 11/1951 Schwenger ..... 313/273 X
4,788,469 11/1988 Holten ..... 313/113

*Primary Examiner*—Palmer C. DeMeo
*Attorney, Agent, or Firm*—Robert J. Kraus

[57] ABSTRACT

An electric incandescent lamp includes a lamp vessel having an axis and a reflective coating. Within the lamp vessel two filaments are arranged in a disc-shaped space transverse to the axis and which are electrically connected in series, the second end portion of the first filament being electrically connected to the first end portion of the second filament. Mains voltage is applied between the first end portion of the first filament and the second end portion of the second filament. The filaments are arranged opposite each other so as to substantially surround the axis of the lamp vessel, and are closest to each other at the corresponding end portions thereof. Such end portions are separated by a gap in either or both the axial and transverse directions. The lamp produces a symmetrical light beam of high intensity at its center.

4 Claims, 2 Drawing Sheets

ELECTRIC INCANDESCENT LAMP

BACKGROUND OF THE INVENTION

1. Field of the Invention

The invention relates to an electric incandescent lamp comprising

- a translucent lamp vessel with an axis provided with a reflective coating,
- a first and a second wound filament respectively having a first and a second end portion and which are arranged in the lamp vessel near the axis thereof, and
- current supply conductors respectively connected to the end portion of the first and the second filament and which exit from the lamp vessel.

2. Description of the Related Art

Such a lamp is known from Netherlands Patent 121 505.

In the known lamp, there are two linear filaments which are arranged at an angle of 45° to the axis and either at right angles or parallel to each other.

This arrangement results in that portions of both filaments are at a great distance from the axis of the lamp vessel. This has the consequence that the light beam formed by the reflective coating of the lamp vessel has a large width and consequently a low luminous intensity at the centre thereof. Another consequence is that the light beam is inhomogeneous and not axially-symmetrical. The filaments may have different powers; for example, one filament may have a power twice that of the other.

Various other incandescent lamps having several parallel-connected filaments are known. For example, Patent EP 0 280 475-A discloses a lamp having two transversely arranged filaments forming a closed figure. One of these filaments is designed for a longer life than the other. This has for its object that the lamp will continue to emit light for a long time after the other filament has already burnt through.

Such a lamp is not efficient because the filament having the longest life inevitably has a lower light output per unit of energy consumed. The net light output of the filament having the longest life is even lower than the gross light output thereof because by evaporation of the material of the filament having the shortest life, after it has burnt through, a light-absorbing deposit of evaporated filament material forms on the lamp vessel.

A similar lamp is known from Patent Specification GB 426 477.

The aforementioned Patent EP 0 280 475-A also discloses a lamp having three filaments. Two of these filaments are connected in parallel with each other and both in series with the third filament. These filaments are designed to have different lives; one of the parallel-connected filaments has the shortest life, while the third filament has the longest life.

In incandescent lamps having a reflective coating, the filament is usually arranged transversely to the axis of the lamp and is helically wound around its own axis. Such an incandescent lamp is known, for example, from Applicant's U.S. Pat. No. 4,788,469. Due to the comparatively great length of an incandescent filament for operation at mains voltage, this filament extends, helically around its axis, to a comparatively great distance from the lamp axis. A comparatively large width of the light beam formed is the result. Other consequences of the position and the shape of the filament are the formation of a non-symmetrical light beam and a comparatively low luminous intensity at the centre thereof.

SUMMARY OF THE INVENTION

An object of the invention is to provide a lamp of the kind described in the opening paragraph, which has a more symmetrical light beam having a high luminous intensity at the centre of the beam.

According to the invention, this object is achieved in that the first and the second filament are electrically connected in series, the second end portion of the first filament being electrically connected to the first end portion of the second filament and the first and the second filament, are arranged opposite each other around the axis of the lamp vessel substantially in a disk-shaped space transverse to said axis so that their like end portions are located closest to each other.

Due to the arrangement of the filaments, light is generated around such axis of the lamp vessel and a beam of high symmetry is obtained. This is the case although the like end portions of the filaments are separated by a distance of several millimeters in order to prevent electrical flash-over. Not the full mains voltage, but only a part, for example half this voltage, is produced between these like end portions, so that the risk of flash-over is reduced. By the use of a filling gas at a comparatively high pressure, especially a filling gas having a high ionization energy, such as, for example, nitrogen, the risk of flash-over can still further be reduced. Due to the fact that in the lamp according to the invention there are two filaments, whereas only one filament, would require, when arranged around the lamp axis, a comparatively large gap between the end portions of said filament, in the lamp according to the invention this gap is divided as between both filaments around the axis of the lamp vessel.

In a favourable embodiment, the filaments are arranged so that the gap extends entirely or in part in axial direction. In such arrangement the like end portions of the filaments are a certain mutual distance apart in the axial direction. The disk-shaped space in which the filaments are arranged then has a larger dimension in the axial direction of the lamp vessel than when the filaments extend entirely in a plane transverse to the axial direction.

In a conventional lamp the filament mostly has the form of a trapezoid open at its base, whereas in the lamp according to the invention the filaments entirely or substantially entirely surround the lamp axis. The light source of the lamp according to the invention is thus much more compact than in a conventional lamp, the greatest distance and the average distance of the filament from the axis of the lamp vessel being less than in the conventional lamp. The compact light source, close to the axis of the reflective lamp vessel, results in a narrow light beam having a high luminous intensity and a very high luminous intensity at the centre. The luminous intensity of the beam is more than about 50% higher than in a conventional lamp.

Preferably, the first and the second filament are similar and have the same specifications, such as, length, wire thickness and pitch.

BRIEF DESCRIPTION OF THE DRAWINGS

Embodiments of the incandescent lamp according to the invention are shown in the drawings, wherein.

DESCRIPTION OF THE PREFERRED EMBODIMENTS

Figure 1:
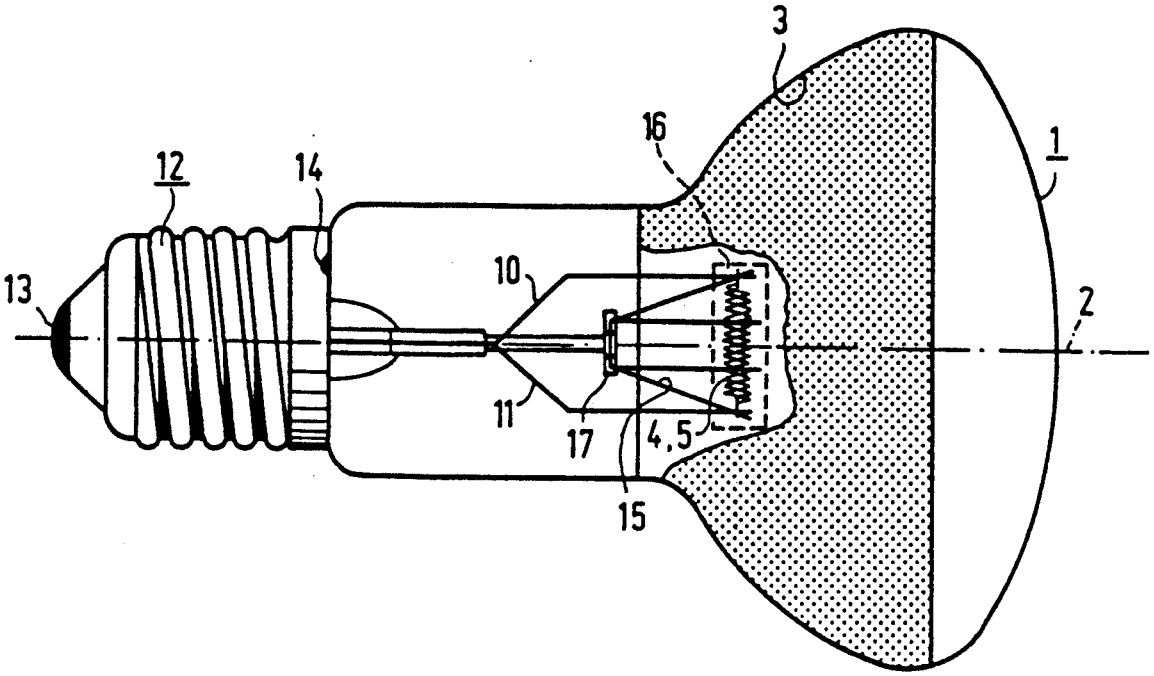
FIG. 1 is a side elevation of a first embodiment showing the lamp vessel partly broken away.

In FIG. 1, the electric incandescent lamp to be operated at mains voltage has a translucent lamp vessel 1 with an axis 2. The lamp vessel is provided with a reflective coating 3, for example an aluminium layer applied by vapour deposition.

A first and a second helically wound filament 4, 5 (see also FIG. 2) respectively having a first end portion 6, 8 and a second end portion 7, 9, are arranged in the lamp vessel 1 near the axis 2 thereof. Current supply conductors 10, 11, which are respectively connected to a respective end portion 6, 9 of the first and the second filament 4 and 5, exit from the lamp vessel. The lamp shown has an Edison lamp cap 12 provided with contacts 13 and 14, to which a respective current supply conductor 10, 11 is connected.

In the embodiment shown, the mirror-coated part 3 of the lamp vessel 1 is parabolic, but this part could have been shaped differently, for example, in the form of an ellipse, or by rotating a curve, for example a branch of a parabola or an arc of a circle, about the axis 2.

The first and the second filament 4 and 5, respectively, are electrically connected in series (see also FIG. 2) in that the second end portion 7 of the first filament 4 is electrically connected to the first end portion 8 of the second filament 5, i.e. by means of a conductor 15. The first and the second filament are arranged opposite to each other around the axis 2 of the lamp vessel 1 in a disk-shaped space 16 transverse to said axis 2, in which in the embodiment shown the focus of the paraboloid is also located, in such a manner that the like parts of these filaments, i.e. the first end portions 6, 8 and the second end portions 7, 9 are located closest to each other.

In the embodiment shown, the filaments have the same efficiency. They also have the same resistance, as a result of which the voltage across each of the two filaments is half the mains voltage. The minimum distance between the first end portions 6, 8 can thus be equal to that between the second end portions 7, 9. The gap between the filaments extends in the transverse direction so as to be divided into two parts around the axis 2. The conductor 15 and supporting members 18, 19 are anchored in an insulator body 17.

Figure 2:
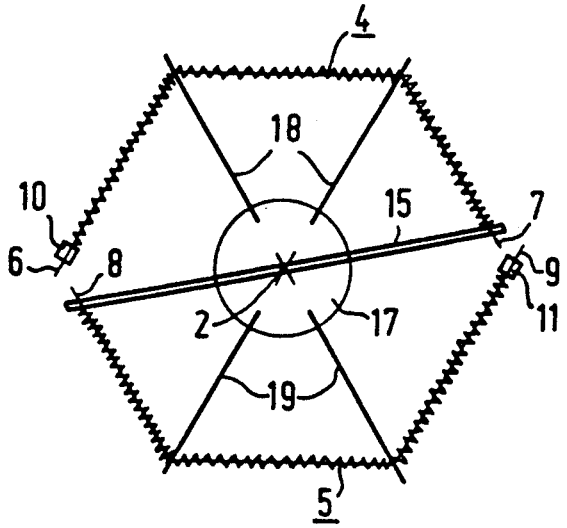
FIG. 2 shows the filaments of FIG. 1, viewed along the axis.
Figure 3:
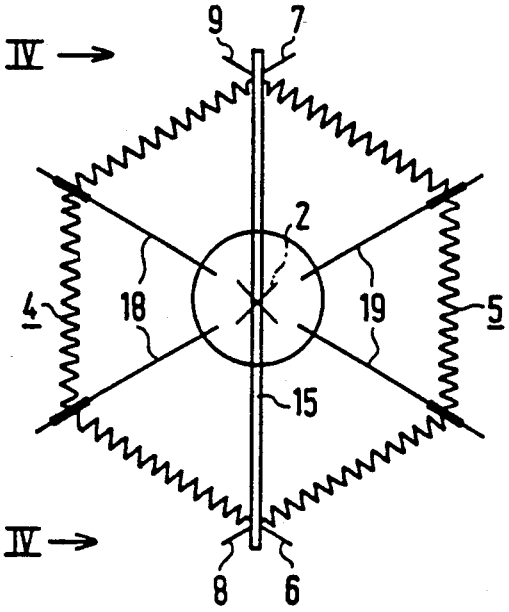
FIG. 3 shows a variation of FIG. 2.
Figure 4:
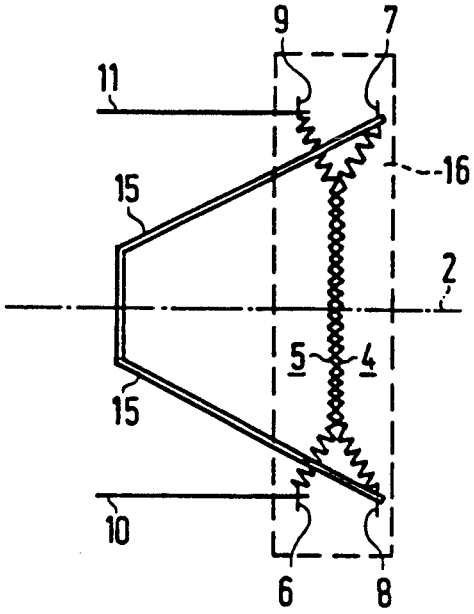
FIG. 4 shows the filament of FIG. 3, viewed along IV in FIG. 3.

In FIGS. 3 and 4, the filaments 4 and 5 have, viewed in the direction of the axis 2, substantially the same geometry as in FIGS. 1 and 2. However, as seen in the side elevation of FIG. 4 the geometry differs from that of FIG. 1. In FIG. 1, the gap between the filaments 4 and 5 extends between the first end portions 6, 8 and between the second end portions 7, 9 transverse to the axis 2 so as to be subdivided into two parts. In FIG. 4 this gap extends in axial direction. As a result, the filaments 4, 5 form, viewed in axial direction, that is to say in the direction in which the lamp emits the generated light beam, a closed figure and they together have a symmetrical configuration. The disk-shaped space 16 in which the filaments are located has in FIGS. 3 and 4 a larger axial dimension, although the latter is kept to the minimum value which is sufficient to prevent electrical flash-over. Combined forms of a transverse and an axial gap are also possible.

Figure 5:
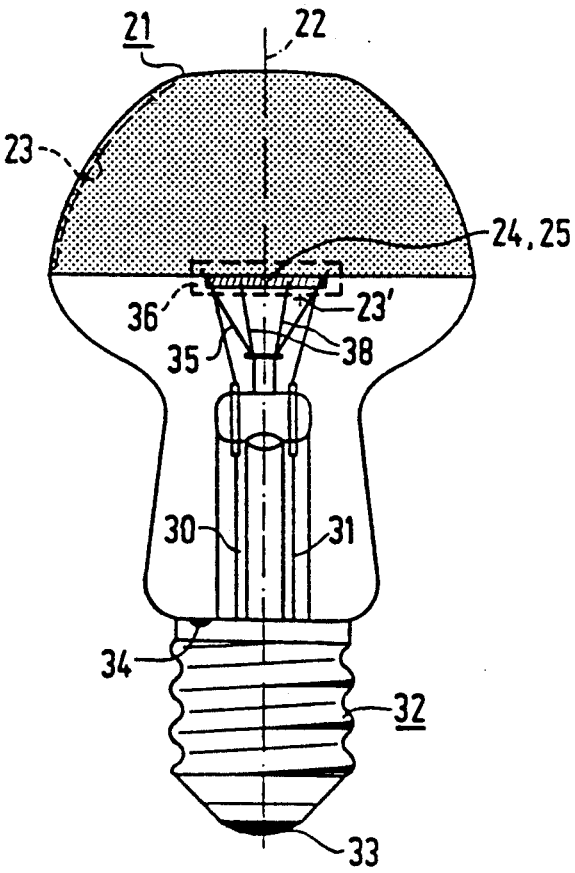
FIG. 5 is a side elevation of another embodiment of the lamp.

In FIG. 5, parts corresponding to parts of FIG. 1 have reference numeral which is 20 higher. The filaments 24, 25 have the same configuration as in FIGS. 1 and 2; they coincide with the largest diameter transverse to the axis 22 of the lamp vessel 21.

The lamp shown is a bowl mirror lamp intended to be used in an outer parabolic reflector. The lamp vessel 21 for this purpose has a reflective coating 23 on the surface remote from the lamp cap 32, which is curved according to the arc of a circle whose centre of curvature 23' is located on the other side of the axis 22 and of the plane with the largest diameter in which lie the filaments 24, 25.

I claim:

1. An electric incandescent lamp comprising:

a translucent lamp vessel having a longitudinal axis and a reflective coating;

a first and a second helically wound elongated filament arranged in the lamp vessel transversely to the axis thereof and each having a first end portion and a second end portion; and a pair of current supply conductors respectively connected to the first end portion of the first filament and the second end portion of the second filament, said conductors exiting from the lamp vessel;

the second end portion of the first filament being connected to the first end portion of the second filament so that said filaments are electrically connected in series;

the first and the second filament being located in a disc-shaped space transverse to said axis and arranged opposite each other so as to substantially entirely surround said axis, corresponding end portions of the two filaments being closest to each other.

2. An electric incandescent lamp as claimed in claim 1, characterized in that corresponding end portions of the two filaments are separated by a gap in a direction transverse to the lamp axis.

3. An electric incandescent lamp as claimed in claim 1, characterized in that the corresponding end portions of the two filaments are separated by a gap in a direction parallel to the lamp axis.

4. An electric incandescent lamp as claimed in claim 1, characterized in that corresponding end portions of the two filaments are separated by a gap which extends partially in a direction parallel to the lamp axis and partially in a direction transverse to said axis.

* * * * *